United States Patent [19]

Mason

[11] Patent Number: 4,640,421

[45] Date of Patent: Feb. 3, 1987

[54] TRUCK CRANE CONVERSION TO CRAWLER CRANE

[76] Inventor: Daniel P. Mason, 4232 N. Kedvale, Chicago, Ill. 60641

[21] Appl. No.: 705,904

[22] Filed: Feb. 26, 1985

[51] Int. Cl.[4] ..... B66C 23/78

[52] U.S. Cl. ..... 212/175; 212/189; 180/9.26

[58] Field of Search ..... 180/9, 9.1, 9.24, 9.26, 180/9.28, 9.3, 9.1, 9.34, 9.36; 212/170, 172, 174, 182, 189, 223, 227, 232, 254, 255, 265

[56] References Cited

U.S. PATENT DOCUMENTS

| | | | |
|---|---|---|---|
| 2,818,275 | 12/1957 | Hollowell | 212/244 |
| 3,056,509 | 10/1962 | Talbert | 212/172 |
| 3,638,805 | 2/1972 | Garnier | 212/244 |
| 3,680,720 | 8/1972 | Strange | 180/9.3 |
| 3,929,204 | 12/1978 | Newell | 180/9.26 |
| 4,085,853 | 4/1978 | van der Lely | 212/265 |
| 4,386,673 | 7/1983 | Carter et al. | 180/9.1 |
| 4,391,343 | 7/1983 | Deare | 180/9.28 |
| 4,415,055 | 11/1983 | Ahn | 180/9.1 |
| 4,483,407 | 11/1984 | Iwamoto et al. | 180/9.1 |
| 4,496,015 | 1/1985 | Porter, Jr. et al. | 180/9.21 |

FOREIGN PATENT DOCUMENTS

| | | | |
|---|---|---|---|
| 2022844 | 12/1970 | Fed. Rep. of Germany | 212/244 |
| 2030250 | 12/1971 | Fed. Rep. of Germany | 212/244 |
| 2040688 | 6/1979 | Fed. Rep. of Germany | 212/254 |
| 277064 | 9/1927 | United Kingdom | 180/9.3 |
| 1193624 | 6/1970 | United Kingdom | 212/254 |
| 745762 | 7/1980 | U.S.S.R. | 180/9.28 |

*Primary Examiner*—Trygve M. Blix
*Assistant Examiner*—Stephen P. Avila
*Attorney, Agent, or Firm*—Basil E. Demeur; Robert E. Knechtel

[57] ABSTRACT

There is disclosed a truck crane of the type having a crane mounted to a truck frame and using wheels for movement which is convertible to a crawler type crane of the type including a truck cab having its own power source and drive train, the frame thereof being split and being engageably disengageable into a forward motive frame section and a rear crane frame section, and the drive train being similarly disengageable to permit the forward motive frame section to be separable from the rear crane frame section, the rear crane frame including a plurality of outrigger jacks positioned on opposed sides of the rear crane frame section, and the frame including a plurality of first mount means positioned on opposing sides thereof, a pair of portable crane tracks, at least one of the pair of crane tracks having an independent power source carried thereon and including flexible motive means for interconnecting the independent power source to a separate control system, and each of the pair of portable crane tracks including mounting fixtures positioned for engageable mounting with the first mount means of the truck frame, whereby the frame and drive train may be split leaving a rear crane frame section, and the portable crane tracks mounted thereon after which the independent power source of the crane track may be connected to its own separate control system thereby to convert the truck crane to a crawler crane.

10 Claims, 18 Drawing Figures

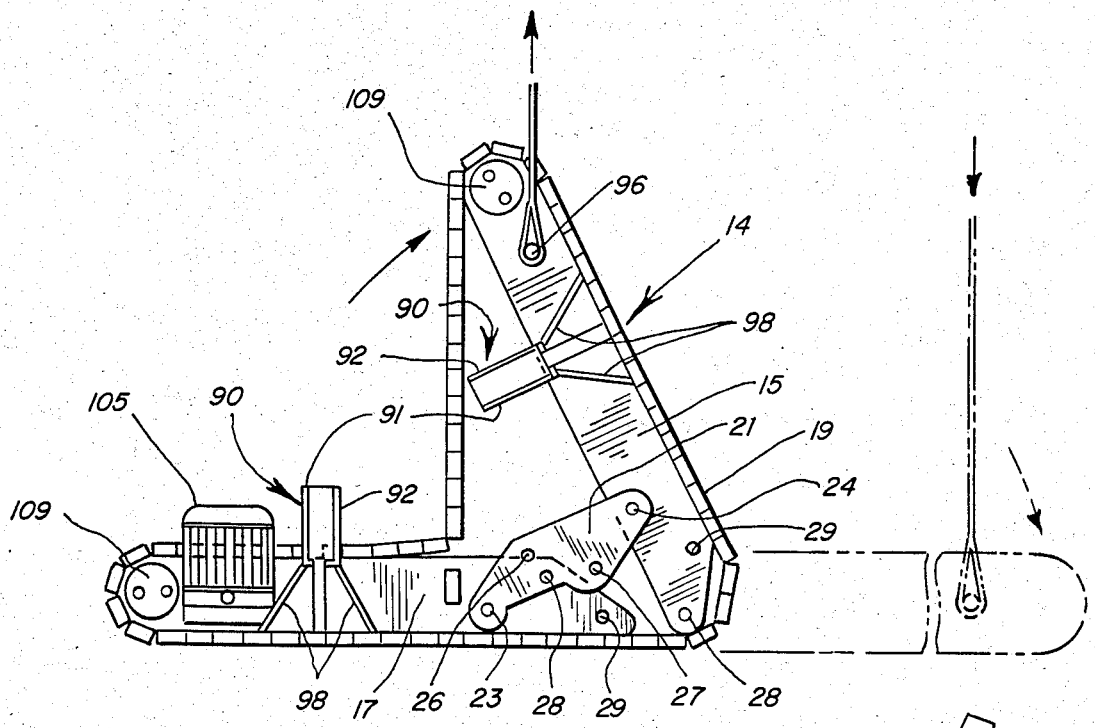
FIG. 3
FIG. 4
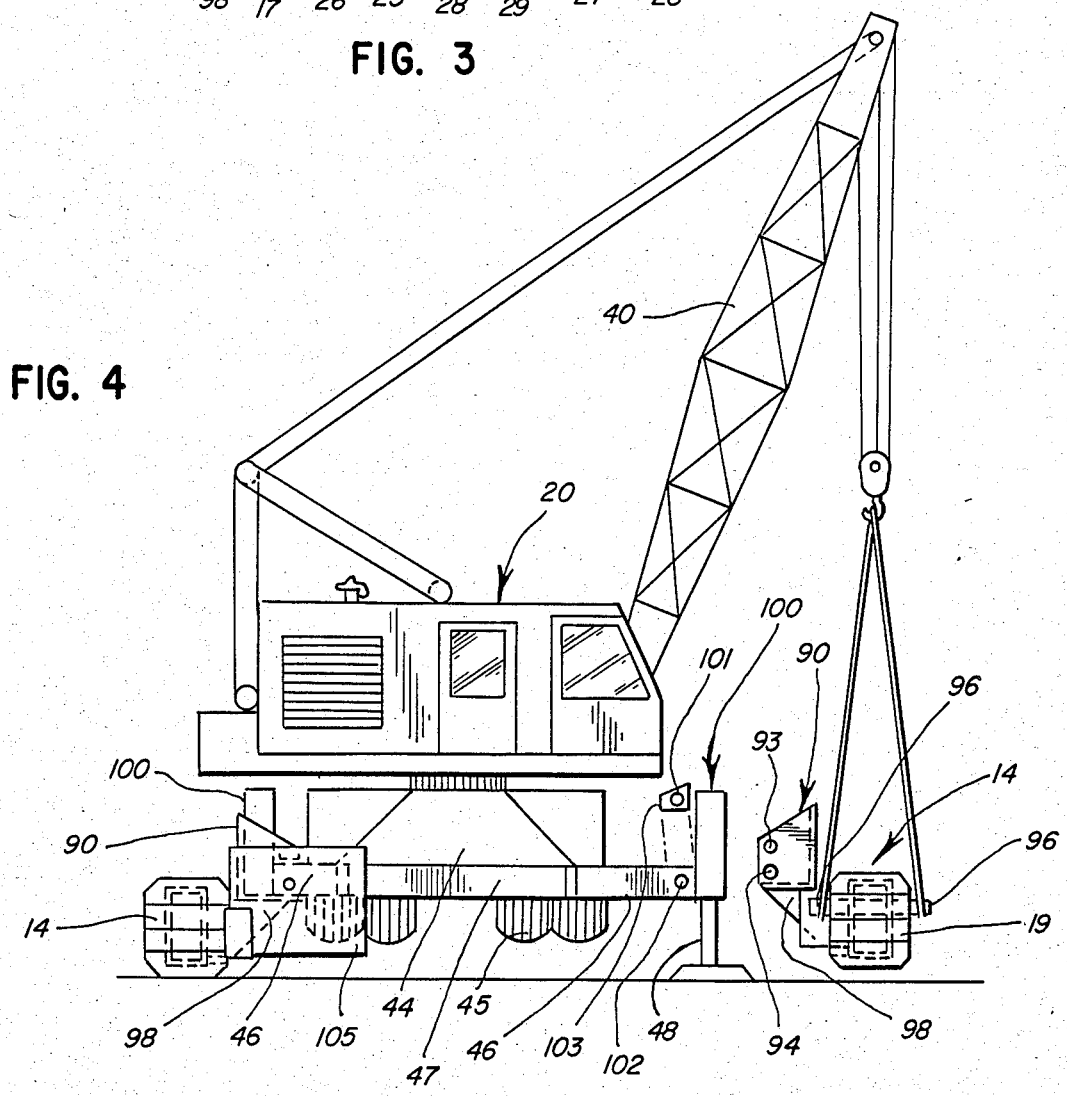

FIG. 5
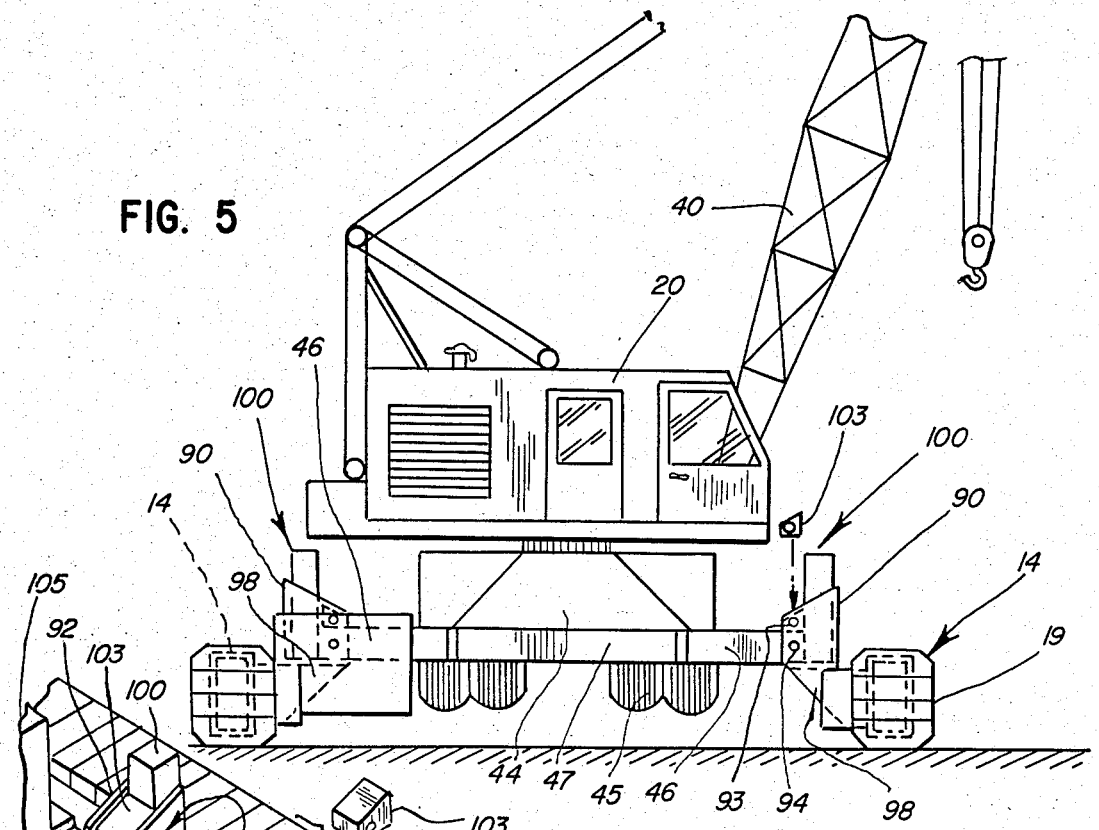
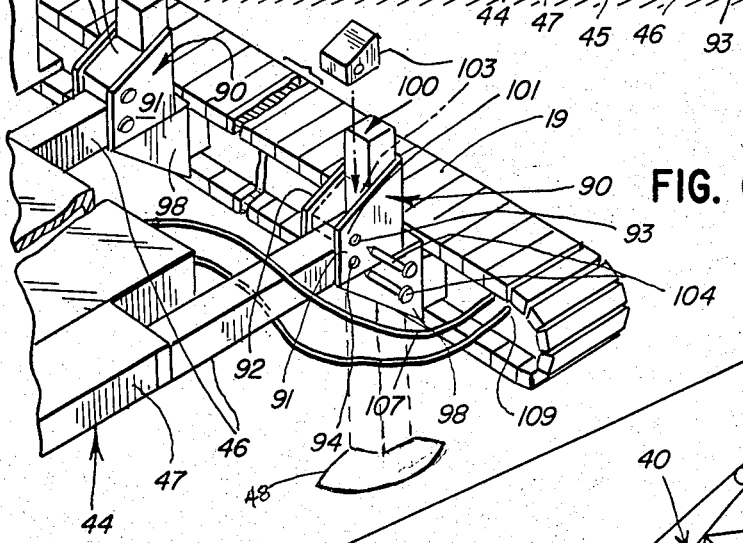
FIG. 6
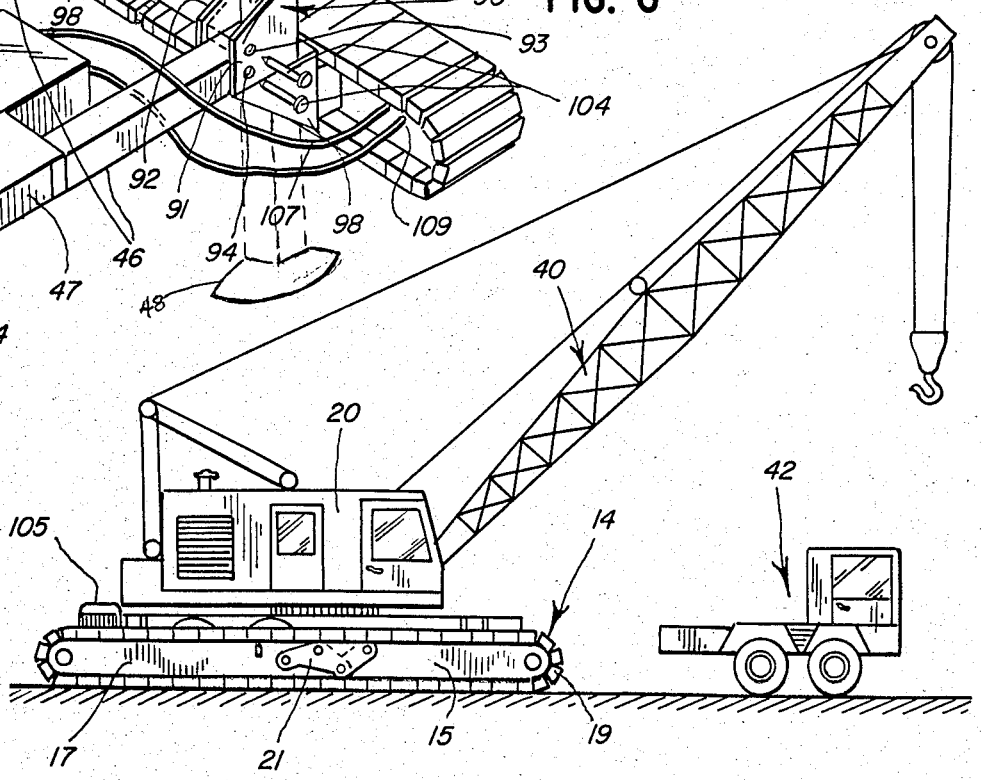
FIG. 7

FIG. 11
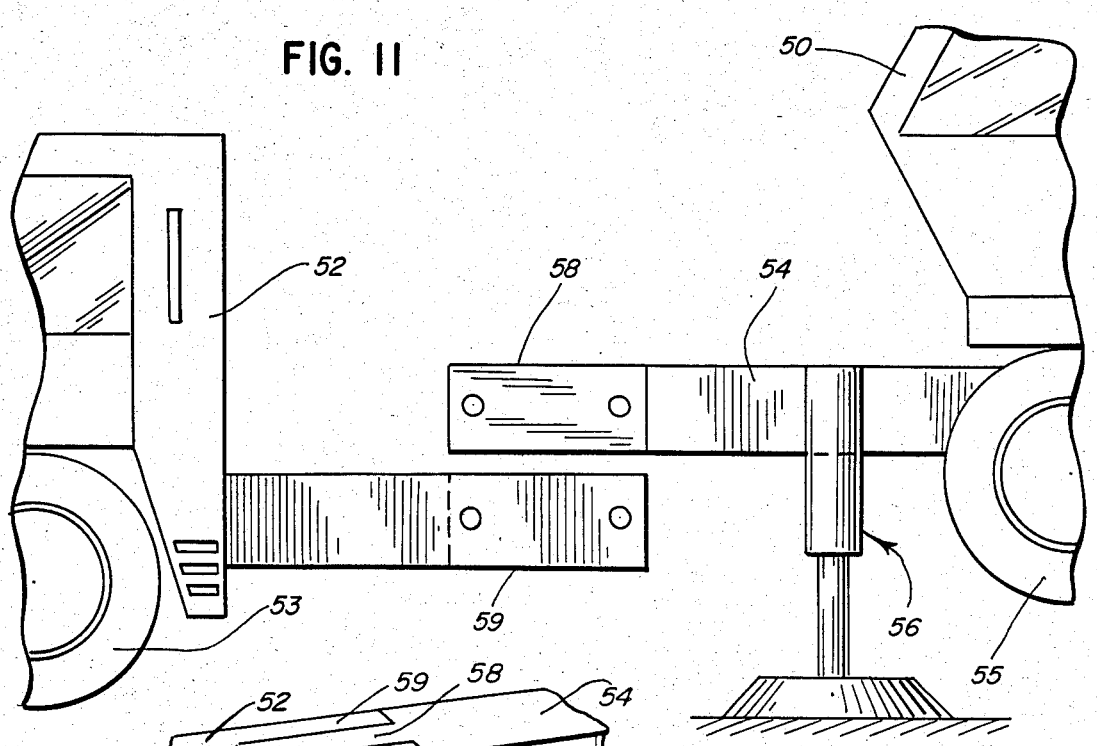
FIG. 12
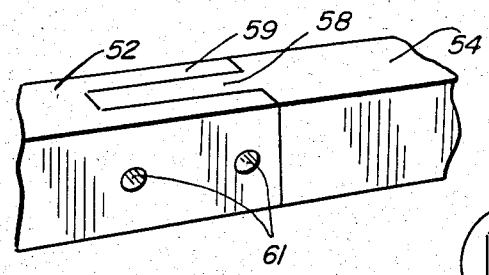
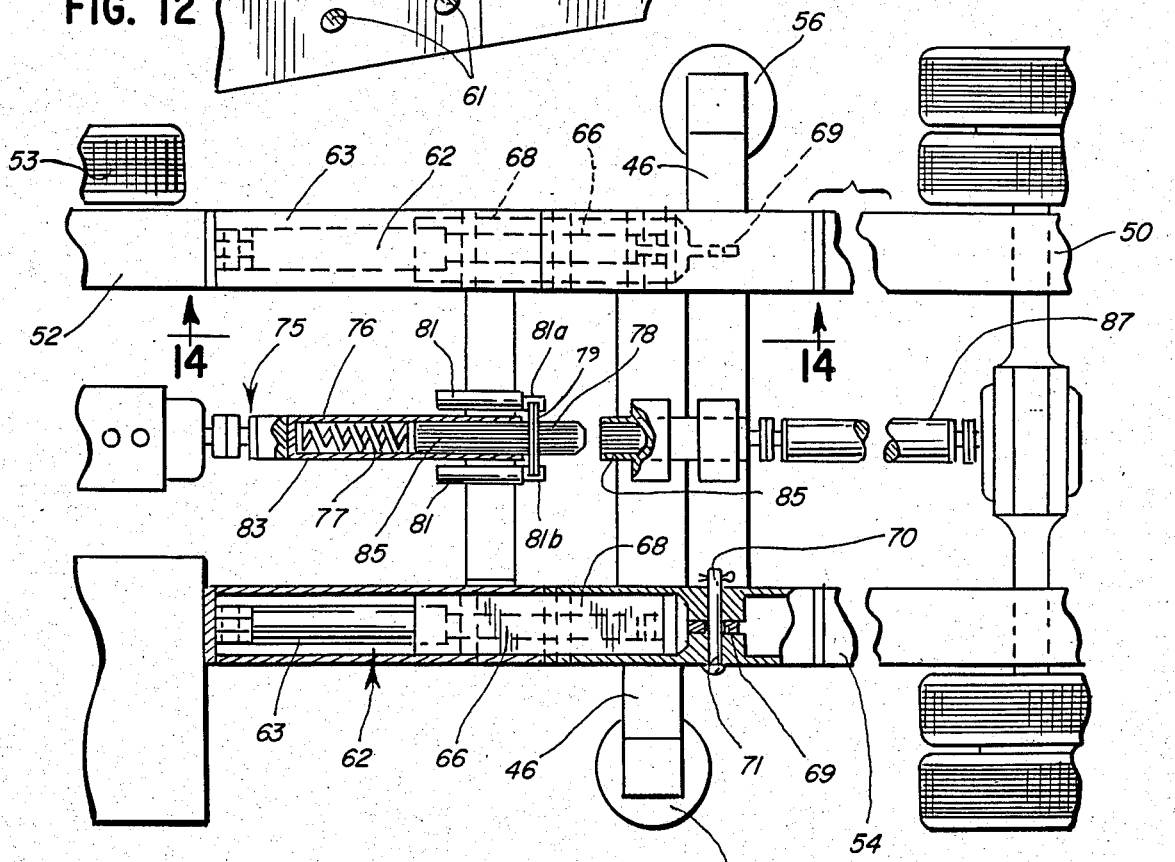
FIG. 13

TRUCK CRANE CONVERSION TO CRAWLER CRANE

BACKGROUND OF THE INVENTION

The use of heavy duty cranes in various industries is quite well known int he art. In recent years, the desirability of having cranes mounted on a truck chassis for movement from one locale to another is well known. Indeed, the art has advanced to the point where extremely large and heavy duty cranes have been mounted on a truck chassis, which include their independent power source such that the truck crane may be driven to any desired location. These types of vehicles re extremely necessary since it is necessary to drive a crane from one locale to another depending upon the location of a construction site.

The typical state of the art truck crane is constructed with the crane mounted on the rear portion of the frame, the front portion of the frame including the truck cab and the engine and drive train of the entire vehicle. Again, typically, the fram eis provided with a series of four outrigger beams such that when the vehicle arrives at the use location, the outrigger beams are extended and the leveling jacks, which are mounted on the end of each outrigger beam in a vertical position, are also extended to engage the ground and raise the entire crane clear of the ground thus effectively supporting the crane on all four outrigger beams and all four leveling jacks. Only in this configuration can the truck crane perform at its rated capacity. However, as is also well known in the art, such vehicles do in fact include the forward portion of the frame, which as indicated previously, contains the truck cab, engine and drive train equipment. For this reason, the vehicle has an elongate configuration and a significant degree of weight. Hence, when the crane is in use, it is not possible to swing any load forward of the front outrigger beams and jacks for the reason that the weight normally contained at that end of the vehicle, plus the weight being lifted by the crane, would have the tendency to weight down the forward end of the entire structure causing the crane to rise off the extended outrigger beams and jacks, and possible cause the tires on the forward portion of the truck crane or steering end to blow out and bend the truck frame forward of the forward outriggers. This particular drawback of the current state of the art vehicles therefore is restrictive with respect to the use of cranes on situs locations, since the crane operator does not have the full 360 degree arc of use of the crane.

In addition, such current state of the art truck cranes are not capable of mobility once at the job site. It will be appreciated that once the truck crane is placed in position, and the outrigger jacks engaged with the underlying ground, the vehicle can no longer be moved when in use. Hence, it is incumbent upon the crane operator to simply lift and lower loads from his single location. The only mobility afforded to the operator is the circumferential path of travel permitted by the circumferential movement of the crane. Hence, it is not possible to move a load from one locale to another by the use of a truck crane. Typically, such mobility is only chieved by transporting to the job site an additional crane, being the crawler type cranes. These cranes are typically hauled to a job site by means of a trailer. The crawler crane is then removed from the trailer, and is then available for work at the job site. However, it will be appreciated that in this instance, the contracting firm engaged in the construction on the job site is required to have two crane vehicles at the same location in order to accomplish the various lifting and travel functions required by a particular construction project. It will again be appreciated that this is a very costly burden on the contractor since he will have double the labor charges as well as double the equipment charges in order to have the advantage of two different types of cranes at the same job site.

Hence, the current state of the art cranes in use have at least two drawbacks with respect to on site usage, those being the limitation in terms of the circumferential path of travel of the crane when employing truck cranes of the type with outrigger jacks as well as the immobility of the truck crane once securely positioned on the job site.

At least one attempt has been made inthe patented art to circumvent the problem of having multiple cranes at a single job site. U.S. Pat. No. 3,929,204 makes an attempt at solving this problem by providing a crane which is mounted on a wheeled trailer, and which the patentee indicates may be converted to a crawler crane on the job site. It will be observed from a view of FIG. 7 of the drawings of the U.S. Pat. No. 3,929,204, that the patentee contemplates the mounting of portable tracks onto the trailer frame by unbolting and removing the outrigger jacks, and installing in the same position the portable crane tracks. It will be observed that in order to accomplish this operation, a separate portable jack must be utilized in order to jack up the trailer frame, which must then be supported with blocks, in order that the outrigger jacks may be removed. Once the outrigger jacks are removed, the crane is manipulated in order to bring the crane tracks into position for mounting onto the mounting apertures where the outrigger jacks were previously located. It will therefore be appreciated that the installation of the portable tracks onto the trailer frame is a rather cumbersome procedure.

In addition, while the subject patent discloses the use of a crane tractor trailer which would be hooked up to the fifth wheel of a typical truck cab, no such equipment presently exists. Hence, while the patentee discusses the advisability of pulling the crane on a wheeled frame to the job site by means of a truck cab, and then converting the crane to a tracked vehicle, the art field has not adopted this procedure since no commercially available units of this description are available.

Finally, the U.S. Pat. No. 3,929,204 discusses the advisability of employing motorized tracks such that each of the tracks would have its independent power source to operate the track. While it is deemed advisable to have motorized tracks, nevertheless, the patent is less than clear on the manner in which an operator can obtain control over the tracks from the crane cab. The Patentee discusses the advisability of removing the hydraulic lines which operate the outrigger jacks, and connecting those to the power sources of each of the tracks, but it is submitted that the main control for the outrigger jacks would simply have an up and down function, which would basically relate to a two position switch. Possibly, this could control forward and reverse, but the operator would have no ability to vary the speed of the tracks. In addition, and even more importantly, the controls which operate the outrigger jacks are usually positioned on the frame adjacent to the outrigger beams, rather than in the cab and as such, the controls are removed from the cab area. Furthermore, those controls are supplied with only an 18 gallon per minute pump which is insufficient to power the tracks for movement. Therefore, even if one produces a crawler crane as suggested by Newell, there is no teaching of how such a crane would be powered. Hence, it is believed that the Patentee has not truly resolved the difficulties and problems encountered in terms of converting a truck crane to a crawler crane.

The present invention is therefore intended to provide a mechanical system for converting presently existing wheeled crane vehicles to a crawler crane, and incorporate within such a system the ability to connect a power source for the tracks to the main crane cab such that the operator has full control over the functions of the crawler crane.

OBJECTS AND ADVANTAGES

It is therefore the principal object of the present invention to provide a truck crane of the type generally having a crane secured to a truck frame and using a plurality of wheels for movement from one locale to another, convertible to a crawler crane and which provides means for disconnecting and separating the frame members and the drive train to create a forward frame section, and a rear crane frame section, and incorporating means for mounting the portable tracks onto the rear crane frame section.

In conjunction with the foregoing object, it is a further object of the present invention to provide a crane assembly of the type described, wherein the rear crane frame section incorporates a pluarlity of mounting positions, and each of the portable crane tracks is provided with corresponding mounting fixtures such that the mounting means on the frame and the mounting fixtures on the portable tracks may be placed in registry with each other thereby to mount the tracks onto the frame thereby to convert the truck crane to a crawler crane.

In conjunction with the foregoing objects, it is a further object of the present invention to provide a convertible crane of the type described wherein teh mounting fixtures provided on the portable tracks have a raised configuration such that the mounting of the tracks onto the rear frame section will elevate the same in order to insure that the plurality of wheels carried by the rear frame section are elevated above ground level when the tracks are installed thereon.

In furtherance of the objects set forth above, a further object of the present inention is to provide a pair of portable crane tracks of the type described, each of which is formed by a forward and rear support plate for supporting the tracks thereon and having a respective inner meeting ends, the forwrad and rear support plates being interconnected bya centrally positioned pivot plate whereby the forward and rear support plates are movable with respect to each other throughout an arc of approximately 180 degrees whereby said portable crane tracks are foldable for ease of transportation and having over all length and width dimensions which comply with state highway regulations, and while on the other hand, may be easily manipulated to unfold the same and install the same onto the rear frame section incident to the crane conversion process.

Yet another object of the present invention is to provide a mechanical system of the type described above for converting a truck crane into a crawler crane, wherein the presently existing frame and drive train of the truck crane may be severed, and adapted to be disengageably engageaable in order to create a separable forward section, and a rear frame section, which may also include power operated separation means for separating the respective frame members, and employing a splined drive train and a splined housing for permitting the separation and reengagement of the drive train incident to the conversion process.

Further features of the inventio npertain to the particular arrangement of the elements and parts whereby the above-outlined additional operating features thereof are attained.

The inention, both as to it organization and method of operation, together with further objects and advantages thereof, will best be understood by reference to the following specification taken in connection with the accompanying drawings.

BRIEF DESCRIPTION OF DRAWINGS

FIG. 3 is a side elevational view, partly in phantom, showing the foldable track being unfolded by the crane, and illustrating in greater detail the construction of the foldable track including the forward support plate, rear support plate and central pivot plate;

FIG. 4 is a back elevational view showing the truck crane being elevated from the underlying ground by the outrigger jacks, the crane being utilized to install the foldable tracks onto the mounting means of the frame;

FIG. 5 is a rear elevational view showing each of the opposed portable tracks being installed on the frame, thereby completing the conversion of the truck crane to a crawler crane system;

FIG. 6 is a plan view, partly broken away, illustrating the mounting means for mounting the portable track to the frame, and further illustrating the interconnection of the hydraulic lines from the power source of the track to a separate control system;

FIG. 7 is a side elevational view showing the forward motive section of the truck crane being separated from the rear frame section, with the tracks installed on the rear frame section thereby converting the truck crane to a crawler crane and removing the forward cab portion;

FIG. 11 is a side elevational view, partly broken away, showing the manner in which the frame members are separated in order to remove the forward cab section from the rear frame section incident to the conversion process;

FIG. 12 is a perspective view, partly broken away, showing the respective frame members of the forward motive section and the rear frame section interconnected by means of a tongue and groove fitting and being securely fastened by means of connection bolts, or pins;

FIG. 13 is a top plan view, partly in cross section, showing an alternative mechanical method for separating the respective forward motive section and rear frame section, and including hydraulic means for effecting the separation thereof, and further showing the splined drive train shaft and splined housing which permits the separation of the drive train incident to the conversion process;

BRIEF SUMMARY OF INVENTION

Figure 1:
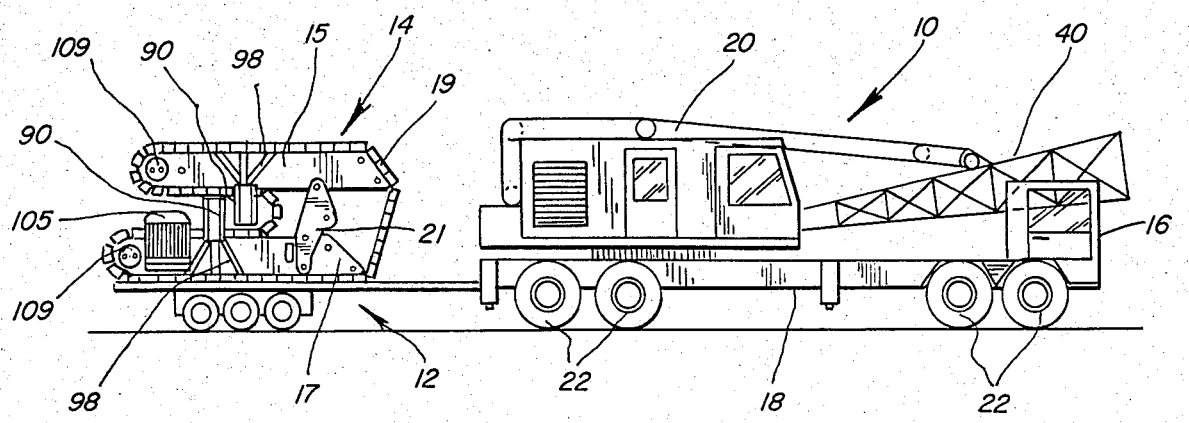
FIG. 1 is a side elevational view showing a typical truck crane formed as a wheeled vehicle, and having the portable tracks of the present invention towed to the job site by means of a trailer.

In summary, the present inention deals with a method and system, and the mechanical elements involved, in converting a presently available truck crane, whether of the lattice boom type, or hydraulic boom type, into a crawler crane. The present invention contemplates that the conversion process may be effected on the job site, thereby eliminating the need to procure and have on site multiple crane systems in order toc omplete a given construction project. Hence, the present invention contemplates the driving of a truck crane to the jobsite, after which, the frame and drive train thereof may be separated, and a pair of portable tracks mounted onto the rear frame section of the vehicle. The tracks, once mounted, will maintain the frame section in an elevated position such that the wheels contained thereon are kept out of engagement with the underlying ground surface, in order to have the crawler crane operate properly. Furthermore, the present invention shows that at least one of the portable tracks contains an independent power source which may be connected to its own separate control system by means of hydraulic lines or the like, such that the crane operator in the crane cab will have full control over the motive power to be applied to the tracks as well as the directional control thereover. Finally, by providing a system which permits the separation of the forward part of the wheeled vehicle from the rear frame section, the operator is capable of eliminating the cantilevered effect which is found in typical truck cranes, such that the crane once converted to a crawler crane on the job site, will have the full lifting and work arc of 360 degrees and will not be hampered by the cantilever effect presently existing with truck cranes.

DETAILED DESCRIPTION OF DRAWINGS

As indicated previously, the present inention is intended to provide the present state of the art in terms of truck cranes with a method for utilizing a truck crane to its fullest capabilities by permitting the easy conversion thereof to a crawler crane on the job site. It is once again, important to note that truck cranes have several drawbacks when being used on a job site location which therefore necessitate that crawler cranes be transported to the job sites such that multiple cranes are generally located on a single job site. the disadvantages noted with respect to truck cranes are important with respect to an appreciation of the present invention, since the present invention eliminates these problems. As indicated previously, truck cranes typically are driven to a job site, and once the proper location for the work effort is located, the truck crane outrigger beams are extended and the leveling jacks, which are fixedly secured to the end of each outrigger beam in a vertical position, are also extended to engage the ground and lift the entire truck crane from ground engagement. Since each leveling jack is independently operated, one can effectively level the crane on uneven ground. It is only in this position that the truck crane's rated capacity (ability to lift a given number of pounds at a given distance from the crane) can be achieved. Once that has occurred, the crane assembly is lifted off of the ground, and therefore, the crane is no longer portable or movable to any other location, unless the boom is retracted, lowered, or disassembled, and the outrigger beams and jacks retracted. In addition, as was indicated previously, since the cab portion of the vehicle is unitary with the rest of the crane assembly, a cantilever effect is realized incident to any lifting opeation. For this reason, crane manufacturers consistently advise contractors that the crane should not be employed to hoist any loads over the cab section of the assembly and hence, there is a quadrnt existing over the forward portion of the truck cab or forward of the forward outriggers, over which the crane operator is not permitted to lift loads. Hence, the crane operator only has approximately three quadrants, or an arc of 270 degrees, to work the crane on the job site location, those three quadrants being the respective opposed sides of the crane, and the portion to the rear of the truck cab which is rearward of the forward outriggers.

In addition, the present invention permits the truck crane to be converted to a crawler crane on site, and hence, give the crane operator mobility with respect to moving lifted loads from locale to locale. Finally, by incorporting an independent power source with respect to the portable track, the crane operator is in a position to control the forward and rear motion of each of the tracks independently of one another, as well as to control the speed thereof.

With reference to FIG. 1 of the drawings, a typical lattice boom truck crane 10 is illustrated. Truck cranes 10 of the type illustrated are presently commercially available, and are well known in the art. As shown in FIG. 1, the truck crane tows a trailer 12 which contains two foldable portable tracks 14 shown positioned thereon. In this manner, the portable tracks 14 may be towed to the job site location by the truck crane 10. As further shown, the truck crane, typically, is formed by a forward cab portion1 6, and a frame 18, which carries the crane 20 thereon. The frame 18 is provided with a plurality of wheels 22 which accomplishes the transporting function.

It is deemed relevant to first discuss the mechanical means for effecting separation of the frame and drive train of the truck crane 10 prior to disclosing the details of construction of the portable track 14, and the method of installing the same onto the frame 18. Hence, with reference to FIGS. 8 through 16 of the drawings, vrious types of truck cranes ar eillustrated, as will be more fully described hereinafter.

Figure 8:
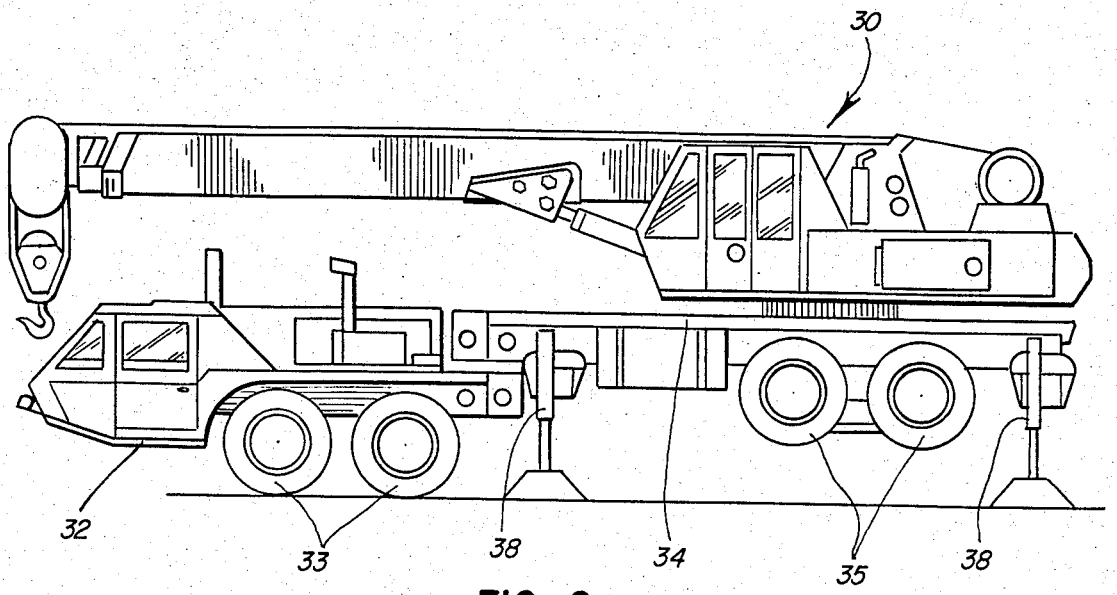
FIG. 8 is a side elevational view illustrating a typical hydraulic boom crane formed as a wheeled vehicle, and incorporating the mechanical systems of the present inention thereon whereby the forward section including the truck cab may be separable and removable from the rear frame section, the rear frame section being shown as elevated from the ground by the outrigger jacks.
Figure 9:
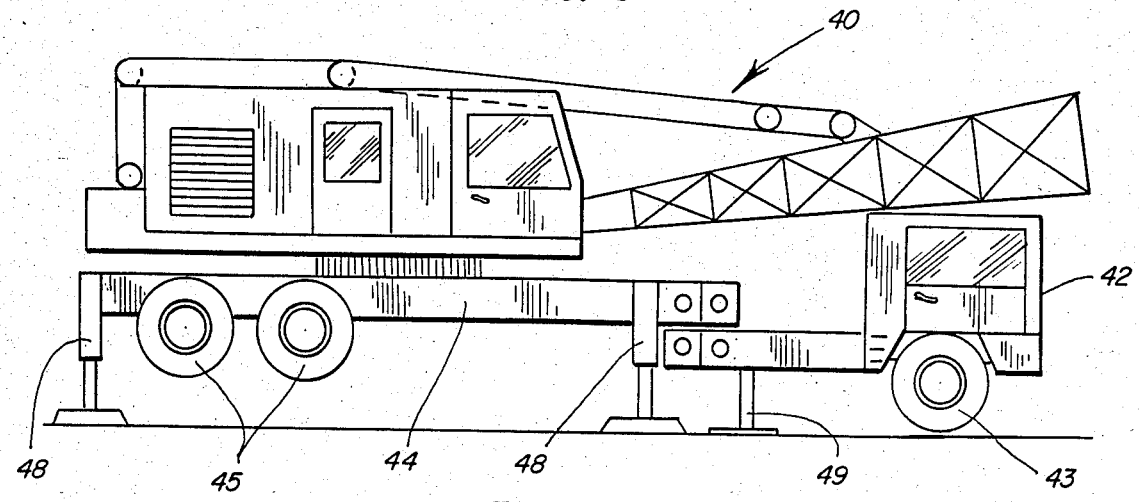
FIG. 9 is a side elevational view, similar to FIG. 8, showing the present invention used in connection with a typical lattice boom truck crane, and again illustrating the frame and drive train separation of a wheeled vehicle wherein the wheeled vehicle only includes driven wheels, and has no independent power source and hence, is left in position by means of rear stabilizer legs.
Figure 10:
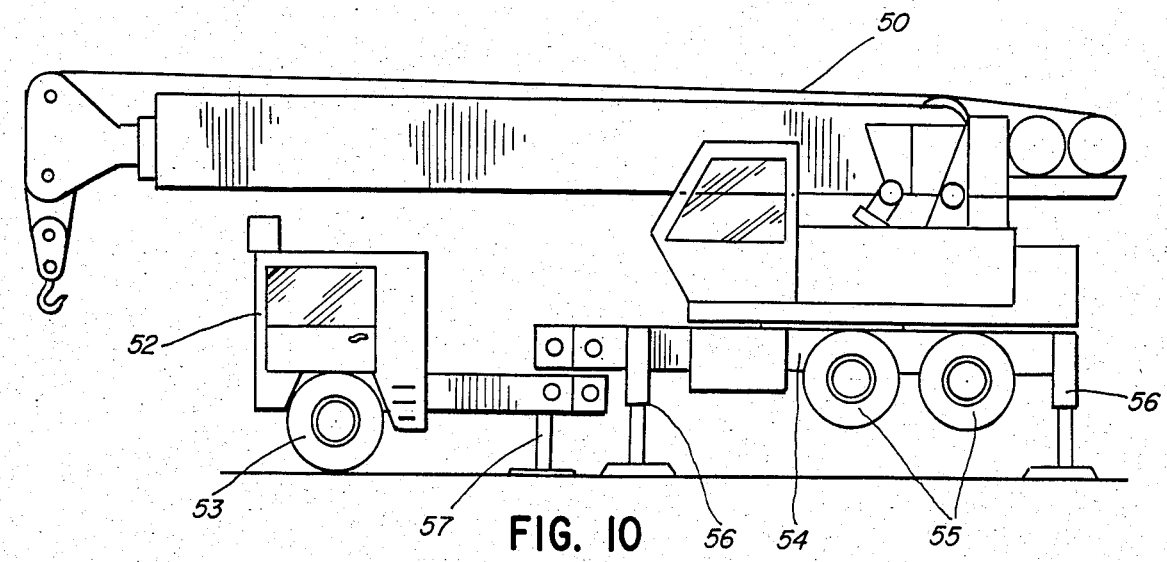
FIG. 10 illustrates a vehicle similar to that depicted in FIG. 9, but clearly indicating that the subject invention can be used on a hydraulic boom type crane and wherein the forward motive section does not have an independent drive train and therefore is separated and left in position by means of one or more rear stabilizer legs.

With reference to FIGS. 8, 9 and 10 of the drawings, the illustration is intended to show that the present invention is equally applicable to the typical truck cranes presently available. In FIG. 8, there is shown a hydraulic boom truck crane 30. The boom truck crane 30 includes a forward cab portion 32, and a rear frame portion 34 respectively. In this embodiment, it is contemplated that the drive train is operable to drive one pair of front wheels 33, as well as one of the pair of rear wheels 35. The rear frame portion 34 is shown to include a series of four outrigger jacks 38, two of which are located on each of the opposed sides of the frame portion 30 as it typically known in the art.

As shown in FIG. 8, the front cab portion 32 is shown to be separated from the rear frame portion 34, with the rear frame portion 34 shown in its jacked and elevated position by having activated the outrigger jacks 38 in a manner known in the art, such that the rear wheels 35 are now elevated with respect to the underlying ground. Hence, once the frame separation has occurred, and the rear frame portion 34 has now been elevated by the outrigger jacks 38 with the rear wheels 35 out of contact with the underlying ground, the front cab portion may simply be stored in a safe lcoation. The relevant point is that the front cab portion has now been removed from the frame 34, and hence, once the portable tracks are installed on the frame portion 34, the crane operator will not have to deal with a cantilever effect in terms of utilizing the boom crane 30. With the tracks now installed, the crawler crane may be moved to any load, regardless of position, and the load lifted and effectively and safely walked to any desired site location. It will be appreciated that prior to conversion, the truck crane must be backed up to a load, secured in positioned, and the load lifted and only arcuately moved. The truck crane cannot walk with the load as lifted. The precise method for effecting the frame splitting will be discussed hereinafter and as more particularly shown in FIGS. 11, 12 and 14 through 16 of the drawings.

FIG. 9 is intended to illustrate the adaptability of the present invention to a lattice truck crane 40 of the type formed by a forward cab portion 42, a rear frame portion 44, and having a pair of front wheels 43, and rear wheels 45. The frame portion 44 is shown to include a series of four outrigger jacks 48 as is well known in the art. Again, as depicted in FIG. 9, the rear frame portion 44 is shown to be separated from the front cab portion 42, with the rear frame portion 44 being elevated by means of the activation of the outrigger jack 48.

In this embodiment, it is contemplated that the front cab portion 42 does not contain a drive train capable of driving the front cab portion independently of the entire assembly, and hence, the present invention contemplates employing a stabilizer foot 49 which would permit the cab portion 42 to simply remain in position, but separated from the rear frame portion 44. Again, the relevant feature is the ability to separate the cab portion 42 from the rear frame portion 44 such that when the portable tracks are installed on the rear section 44, once again, the operator of the crane will not have the problem of a cantilevered effect over the front cab portion 42 in terms of any lifting functions with respect to the opeation of the crane 40 and have the ability to walk up to a load, lift the same, and travel to a site location.

Figures 17, 18:
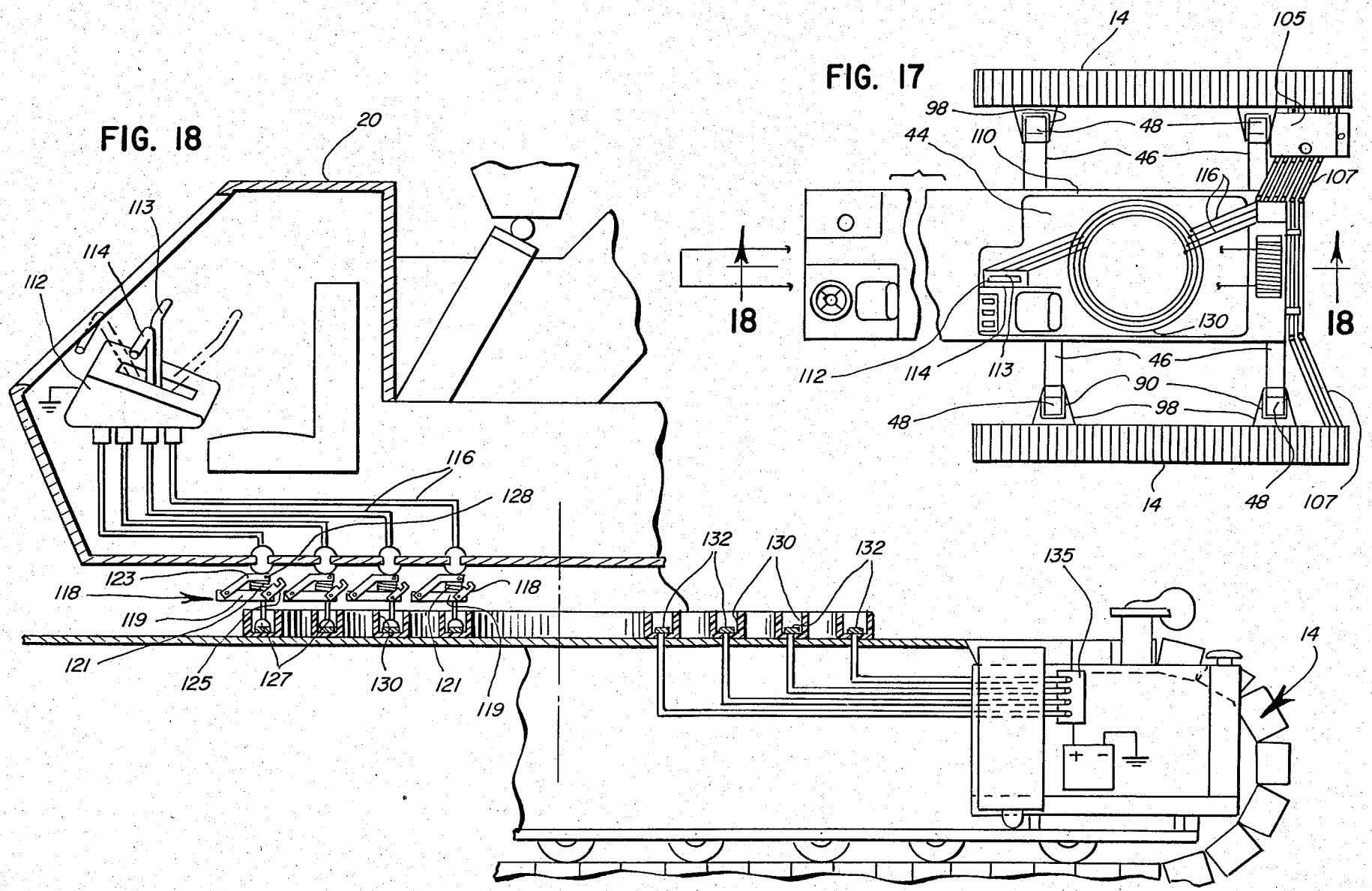
FIG. 17 is a top plan view showing the details of the power connections which extend from the independent power source contained on one or more of the portable tracks via the crane power rails, and the interconnection between the crane power rails and the separate control system inthe crane cab.
FIG. 18 is a side elevational view, in cross section, taken in the direction of the arrows along the line 18—18 in FIG. 17, showing the power connections which extend between the power source on the portable track, via the crane rails, to the separate control system in the crane cab.

As is also illustrated in FIGS. 4, 9 and 17, the rear frame portion 44 is provided with a series of four outrigger beams 46 which are laterally movable within beam housing 47. The outrigger jacks 48 are each fixedly secured and operate within the confines of a corresponding standard 100 which is fixedly secured in a vertical direction along the outer portion of the outrigger beam 46. Hence, the lateral or horizontal result in the lateral or horizontal movement of the standard 100 and the corresponding outrigger jack 48. Hence, to stabilize and lift the crane in position, the outrigger beams 46 are laterally moved outwardly to their fullest extent and the outrigger jacks 48 lowered to ground level until the crane is lifted out of ground engagement. It will therefore be appreciated that the outrigger jacks 48 service the purpose of lifting the frame 44 to permit the engagement of the portable tracks onto the frame 44. This procedure is applicable with respect to each of the crane configurations as illustrated in the drawings.

With respect to FIG. 10, once again, there is depicted a hydraulic boom crane 50 which is formed to include a front cab portion 52, a rear frame portion 54, a pair of front wheels 53, and a series of rear wheels 55. As with the embodiment shown in FIG. 9, the hydraulic boom crane 50 is shown to include a front cab portion 52 which has no independent drive wheels and hence, a stabilizer foot 57 may similarly be adapted to the front cab portion 52 in order to balance and maintain the front cab portion in position once the frame members have been separated. Once again, the crane operator, after installing the portable tracks on the rear frame portion 54, will eliminate the problem of lifting over the forward cab portion 52, and now has the ability to engage in lifting loads throughout a full 360 degree arc around the crane 50, and travel with such loads in the lifted posture.

In FIGS. 11 and 12, one embodiment is illustrated for effecting the separation of the front cab portion 52 from the rear frame portion 54. As shown therein, the rear frame portion 54 may be designed to include a tongue 58, while the front cab portion 52 is shown to include a bifurcated section 59 which is sized in a manner to accommodate the tongue portion 58 therein. A pair of connection bolts 61 may be inserted through apertures appropriately provided such that when the tongue 58 and bifurcated section 59 are re-engaged, the connection bolts 61 are inserted therethrough to firmly lock the front cab portion 51 to the rear frame portion 54. It will be appreciated that with this construction, the disengagement of the respective frame members 52 and 54 respectively can easily be achieved since the connection bolts 61 can easily be removed, and then the outrigger jacks 56 manipulated to raise the rear frame portion 54 relative to the front cab portion 52. The elevation of the jacks 56 will cause the tongue 58 to be removed from the bifurcated section 59 in the manner illustrated in FIG. 11, after which the front cab portion 52 may simply be removed leaving the rear frame portion 54 with the crane 50 in an elevated and free standing position.

Figure 14:
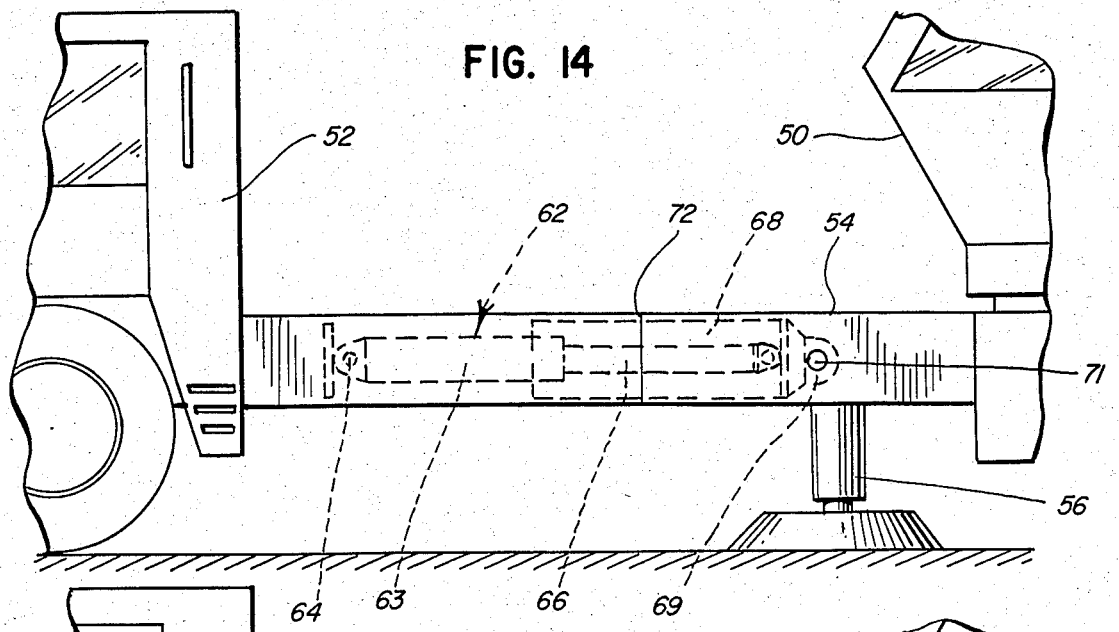
FIG. 14 is a side elevational view, partly in cross section, showing the split frame members having a hydraulic cylinder positioned therein and showing a cylinder rod extended to its fullest extent thereby holding the frame together pending the separation process.
Figure 15:
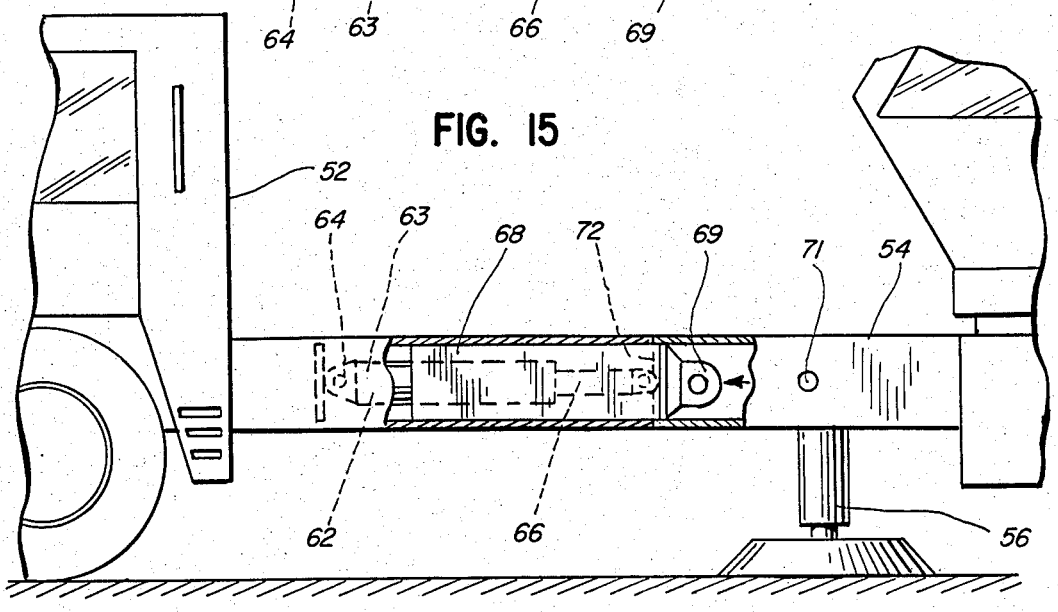
FIG. 15 is a side elevational view, partly in cross section, showing the cylinder rod being retracted into its housing in the forward motive section of the frame with the front eye lock disconnected from the rear frame section.
Figure 16:
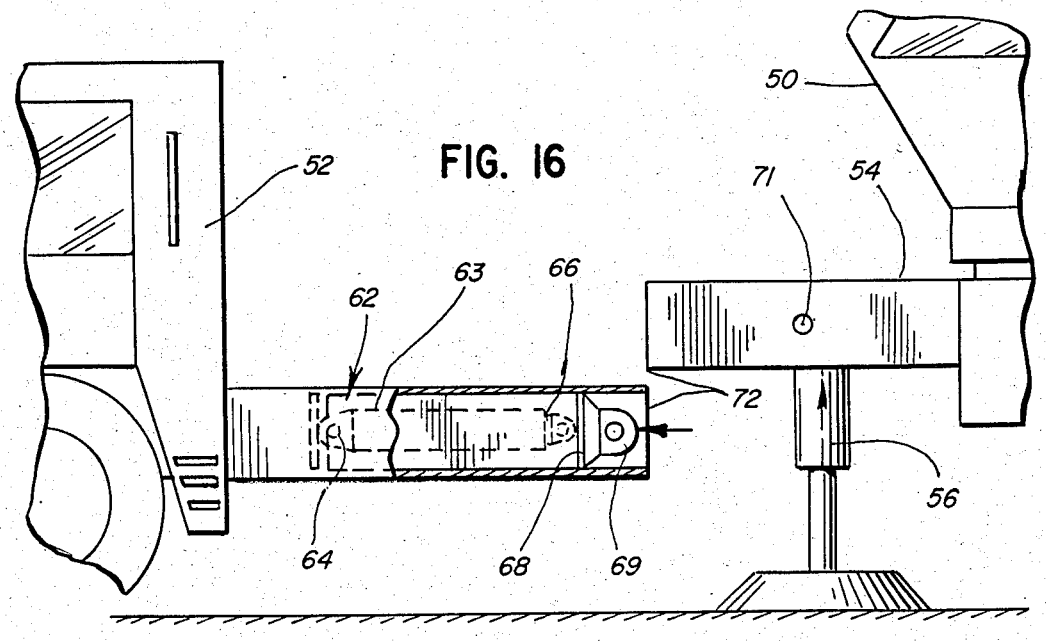
FIG. 16 is a side elevational view, partly in cross section, showing the respective frame members being fully separated with the cylinder rod fully retracted into its housing within the forward motive section of the frame.

In FIGS. 14, 15 and 16 of the drawings, an alterante embodiment for effecting the separation of the front cab portion from the rear cab portion is illustrated. For ease of reference, reference will be made to the front and rear frame sections by using the numbering system which pertains to FIG. 10 of the drawings. It will be appreciated, however, that the system as illustrated in FIGS. 14 through 16 is equally applicable to any of the truck cranes heretofore discussed.

With specific reference to FIG. 14, it will be observed that the crane 50 is, once again, mounted on the rear frame portion 54, while the front cab portion 52 is shown in its engaged posture with respect to the rear frame portion 54. A hydraulic cylinder 62 shown to be interconnected between the front cab portion 52 and the rear frame portion 54. The hydraulic cylinder 62 includes a cylinder housing 63 which is connected to the front cab portion 52 by means of a connection eye 64 and includes a cylinder rod 66 which moves within the cylinder housing 63 in its rear portion, and is fixedly secured to a cylinder shroud 68 at its forward end. The cylinder shroud 68 includes an internal connection eye 69 which is, in turn, disengagebly secured to the rear frame portion 54 by means of a bolt, or other connection means, via aperture 71.

In FIG. 14, the hydraulic cylinder 62 is shown to be in its fully extended position which has the effect of supporting the front cab portion 52 relative to the rear frame portion 54. Once the connection bolt is removed from the bolt aperture 71, the cylinder rod 66 and the cylinder shroud 68 may then be retracted back into the front cab portion 52 as illustrated in FIG. 15 of the drawings. As further shown in FIG. 15, the frame mebers are split along the phantom line 72 such that when the cylinder rod 66 and shroud 68 are fully retracted as shown in FIG. 16, the outrigger jack 56 may be activated to raise the rear frame portion 54 relative to the front cab portion 52. The respective frame members will then be separated along the frame split line 72 as illustrated. Hence, the front cab portion 52 and rear frame portion 54 may be hydraulically separated inthe manner illustrated to accomplish the separation. Once the rear frame portion 54 is separated and elevated as illustrated in FIG. 16, the crane operator may then operate the crane in the manner heretofore described to install the portable tracks as exemplified in FIGS. 2 through 5 of the drawings. The crane 50 is then in an independent posture with the front cab portion 52 eliminated therfrom, such that the crane is now converted to a crawler crane, with full mobility, and a 360 degree arc of lifting function.

It will be appreciated from the above description, that the method or means for separating frame may be manual, hydraulic, or may assume any other format which would mechanically function to split the frame, separate the same, and effect a lifting function with respect to the rear frame portion. It is contemplated that FIGS. 11 and 12 illustrate a manual method for effecting the separation, while FIGS. 14 through 16 illustrate a hydraulic means for accomplishing the same function.

With reference to FIG. 13 of the drawings, the separation of the drive train is illustrated. Again, reference will be made to the crane as depicted in FIG. 10 of the drawings merely for ease of discussing the reference numerals, but it will be appreciated that the split drive train is equally applicable with respect to any truck crane heretofore described and discussed.

As shown in FIG. 13, the crane 50 formed by front cab portion 52 and rear frame section 54 is again illustrated. As was discussed with respect to FIGS. 14 through 16 of the drawings, hydraulic cylinders 62 are provided for effecting the splitting of the frame in the manner heretofore indicated. As illustrated therein, once the connection bolt 70 is removed from the bolt aperture 71, the cylinder rod 66 and cylinder shroud 68 may be retracted in a manner illustrated in FIG. 16 of the drawings.

In order to effect the separation of the drive train 75, a drive train 75 constructed inthe manner as illustrated in FIG. 13 will operate to effect the necessary separation. As illustrated therein, the drive train is shown to include a drive shaft 76 which is formed to have an interior chamber 77 with a splined housing 85 incorporated therein. The rear portion of the interior chamber 77 is accommodated with a spline shaft 78 of sufficient length for retraction to effect separation and reengagement. Disengagement is accomplished by hydraulic jacks 81 and 82 when their associated slotted cylinder heads **81*a* and 81*b*, which hold the shaft 78 within the collar 79, are retracted. Hence, jacks 81 and 82 are activated to retract cylinders 81*a* and 81*b* effectively retracting the splined shaft 78 against the spring 83. To re-engage, the jacks 81 and 82 are relaxed permitting the biasing action of spring 83 to force the splined shaft 78 into engagement with the splined housing 85**.

It will be appreciated from the above description, that the method or means for separating the shaft may be manual, hydraulic (as shown), or assume any other format which would mechanically function to split the shaft, separate the same, and permit reengagement. It is contemplated that the manual method would include a movable sleeve which would overlie the two shaft sections to hold the forward and rear sections of the shaft in position, and slideably move to permit separation.

The rear frame portion 54 is shown to be provided with a splined housing 85 which is sized in a manner to accommodate the splined shaft 78 when the respective front cab portion 52 and rear frame portion 54 are joined together. It will be appreciated that when the respective frame portions 52 and 54 are joined together, the compression spring 83 will operate to biasingly maintain the splined shaft 78 into a journaled relationship with respect to the splined housing 85. When so joined, it will be appreciated that the motive power generated by the drive train 75 will be translated to the rear drive axle 87 in a manner which is known in the art, such that motive power is then provided to the rear wheels 55.

As in shown in FIG. 13, once the hydraulic cylinders 62 have been actuated in order to separate the front cab portion 52 from the rear frame portion 54, the hydraulic jacks 81 and 82 may be activated to disengage the splined shaft 78 from the splined housing 85 in the manner illustrated. Hence, once the hydraulic cylinders have been extended to their fullest extant, both the frame as well as the drive train are now separated. When the cylinder rods 66 and shrouds 68 are now retracted into the front cab portion 52, the separation of the frame is accomplished. The retraction of the cylinder rods 81*a* and 81*b* completes separation of the drive train.

It is also contemplated that any other systems aboard the subject truck crane may be similarly designed with quick disconnects, hence, such items as brake lines, fuel lines and the like may be designed with quick disconnects such that any of the hydraulic or fuel lines existing int he undercarriage of the vehicle may similarly be separated at the time of separation of the axle and the drive train.

It will be appreciated that once the vehicle frame and drive train have been separated as described hereinabove, it now becomes pertinent to describe the manner in which the portable tracks may be installed onto the vehicle frame. Reference will therefore be had to FIGS. 2 through 7 of the drawings which clearly indicates the manner in which the procedure may be accomplished.

As shown in FIGS. 1 and 3 of the drawings, each of the pair of foldable tracks 14 was formed by a forward support plate 15 and a rear support plate 17 which function to support the tracks 19 thereon. The forward support plate 15 and rear support plate 17 are foldable with respect to each other, by means of a pivot plate 21 which is pivotally secured to each of the forward and rear support plates 15 and 17 respectively at pivot points 23 and 24. To futher strengthen and rigidify the forward and rear support plates 15 and 17 when the same are in the unfolded position, pivot plate 21 is provided with a pair of securement apertures 26 and 27 respectively. It will be noted that the rear support plate 17 as well as the forward support plate 15, each include a pair of mount apertures 28 and 29 respectively and it will be observed that when in the unfolded position, the securement apertures 26 and 27 formed in the pivot plate 21 will come into registry with the respective mount apertures 28 and 29 formed in the forward and rear support plates 15 and 17 such that securement bolts (not shown) may then be inserted therethrough in order to rigidify the track 14 in its unfolded position.

Each of the portable foldable tracks 14 is shown to further include a pair of raised apertured gusset plates 90 which are fixedly secured to the forward and rear support plates 15 and 17 respectively. As illustrated in FIGS. 4, 5 and 6 of the drawings, the rear frame portion 44 of the lattice boom truck crane 40 is provided with two pairs of outrigger beams 46 which are apertured adjacent the outer end thereof, each outrigger beam 46 being provided with an upstanding standard 100 formed integrally thereon at the outer end thereof. As indicated previously, the outrigger jack 48 is fixedly secured within and operates within confines of the upstanding standard 100 in the manner well known in the art. It will further be observed that each gusset plate is actually formed by a pair of spaced plates 91 and 92, the plates 91 and 92 being spaced a sufficient distance to accommodate the apertured standard 100 therebetween. A separate apertured block 103 is provided, which is sized to fit between the spaced plates 91 and 92 respectively, of each gusset plate 90. As will be observed, the aperture 101 formed in the block 103 comes into registry with a corresponding aperture 93 formed in the plates 91 and 92. As indicated, the gusset plates include a pair of apertures 93 and 94, which, during the mountign procedure, come into registry with corresponding apertures 101 and 102 (FIG. 4) formed in the apertured standards 100 and apertured blocks 103.

As shown in FIGS. 3 and 4 of the drawings, each of the tracks 14 is provided with lift pins 96 in order to permit the lattice boom crane 40 to perform the lifting function. It will be appreciated that the lift pins 96 are located on both the forward and rear support plates 15 and 17 respectively such that once the track has been unfolded as illustrated in phantom in FIG. 3, appropriate cables from the lattice boom crane 25 may be hooked onto the lift pins in both the forward and rear positions in order to lift the entire track incident to the mounting procedure, as illustrated in FIG. 4.

Figure 2:
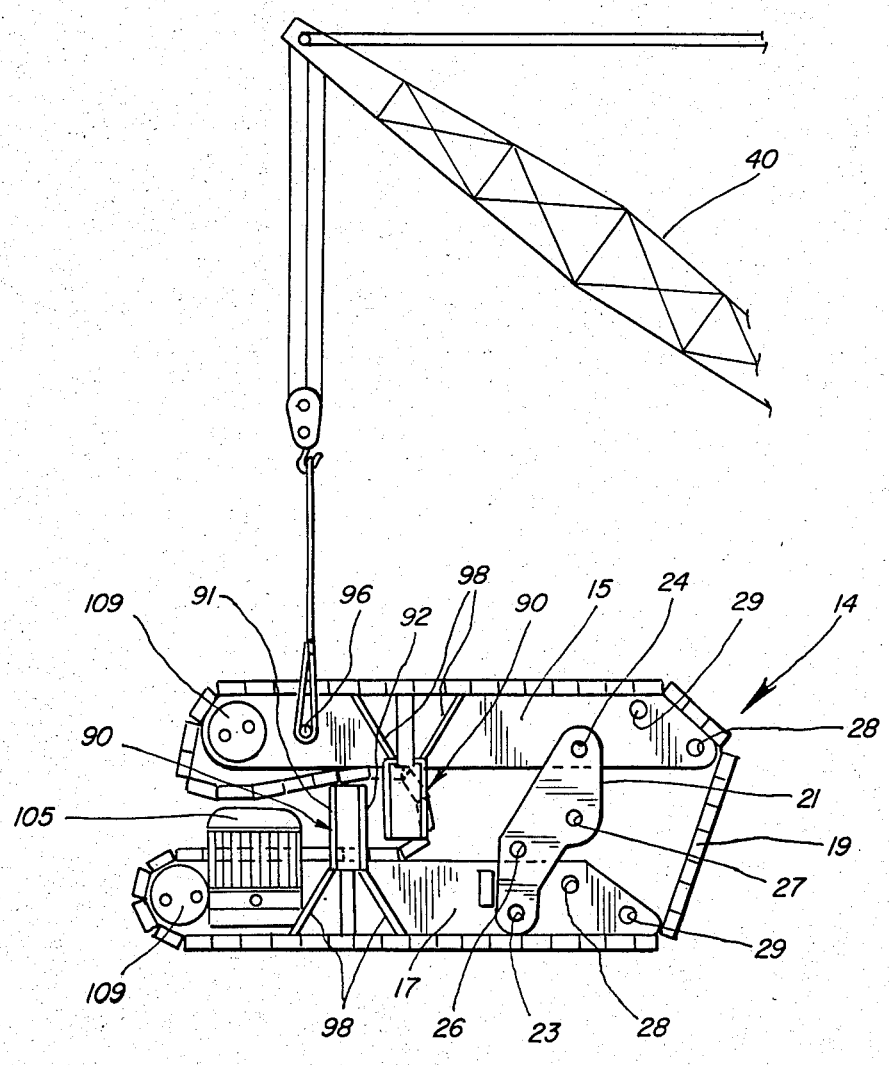
FIG. 2 is a side elevational view showing the portable track of the present invention in its folded posture, and showing the use of the truck crane to commence the unfolding and insertion process of the track to the truck.

As further shown in FIGS. 2 and 3 of the drawings, each of the foldable tracks 14 may be provided with an independent power source 105 which is fixedly secured to one of the support plates 15 or 17 respectively. The power source 105 is provided with motive power connection means (not shown) which permits the attachment thereto of flexible motive liens such as hydraulic lines 107 (FIG. 6) which interconnect the power source 105 to the crane 20. It will further be appreciated that the power source 105 is mechanically connected to the track gears 109 in a manner which is well knwon in the art. It will therefore be appreciated that the power source 105 which is mounted to the portable track 14, is adapted to receive the hydraulic lines eminating from the crane 20, thereby to interconnect the power source with the controls located in the cab of the crane 20, and to similarly be interconnected with the track gears 109 such that the operator of the crane 20 will have full and complete control over the crawler crane once the tracks 14 are installed onto the frame as indicated hereinabove.

It will also be appreciated from a view of FIGS. 4 and 5 of the drawings, that the gusset plates 90 are mounted to the forward and/or rear support plates 15 and 17 respectively in a position raised with respect to the tracks 14. This is accomplished by mounting the gusset plates 90 on appropriate extension plates 98. The advantage of this construction is to the effect that once the gusset plates are positioned in registry with the aperture standard 100, and bolted into place by bolts 104 (FIG. 6) the entire frame 44 as well as the rear tires 45 will be in an elevated position relative to the underlying ground with the tracks 14 in touching contact with the ground surface. This is illustrated inf igures 4 and 5 of the drawings. It will be appreciated that in order for the present invention to operate properly, the attachment fixtures for attaching the tracks 14 to the frame 44 must be positioned as such that the overall carriage and frame 44 of the vehicle be in an elevated position in order to alleviate any difficulties which may exist with respect to the rear wheels being in any type of touching contact with the underlying ground once the tracks 14 are installed onto the vehicle. After installation of the tracks 14, the jacks 38, 48 or 56 are retracted thus effectively transferring the weight of the crane to the tracks 14 thereby establishing mobility.

With respect to FIGS. 17 and 18 of the drawings, the manner in which the tracks 14 may be controlled by the crane cab 20 is illustrated. As shown in FIGS. 17, the undercarriage 110 of the crane is illustrated. FIG. 18 is intended to illustrate the interior of the crane cab 20 showing a master control box 112 which incorporates a split handle 113 and 114 respectively. As is known in the art, the master control box 112 includes electrical contacts such that the positioning of the split handles 113 and 114 will electrically actuate the forward and rearward motion of the tracks independently of one another. As shown in FIG. 17, electrical conduits 116 extend from the master control box 112 to spring loaded contact shoes 118. The spring loaded contact shoes are shown to include a base plate 119 carrying a coiled spring 121 there atop. A comrpession arm 123 is pivotally mounted to the base plate 119 and extends over the top of the coiled spring 121. A locking arm 125 is similarly pivotally mounted to the base plate 119 which is designed to move forward and lockingly engage the compression arm 123. A contact shoe 127 is mounted to the base plate 119 and extended downwardly therefrom for engagement in an appropriate U-shaped track 130. It will be apparent that each of the contact shoes 127 may be disengaged from the corresponding U-shaped track 130 by manually effecting the compression of the coiled spring 121 such that the base plate 119 moves upwardly thereby carrying the contact shoe 127 upwardly. Hence, each of the spring loaded contact shoes 118 may be disengaged from an appropriate U-shaped track 130 and lockingly held inposition by causing the locking arm 125 to lockingly engage a pin 128 thereby maintaining the contact shoe 127 out of electrical contact with the U-shaped track 130 to prevent the shoes 127 from wearing out when the track attachment is not in use.

It will be appreciated that the spring loaded contact shoes 118 are mounted to the under portion of the crane cap 20, and designed to run in a numer of U-shaped tracks 130 as is illustrated in FIGS. 17 and 18 of the drawings. Each of the electrical conduits 116 eminating from the control box 112 are therefore designed to opeate the portable tracks. Again, with respect to FIG. 17 of the drawings, it is clear that electrical contact is established as between the master control box 112, and the power source 105, via the electrical conduits 116, which in the preferred embodiment of the invention, are designed as quick disconnects well known in thea rt, such that once the portable tracks 14 are installed onto the frame 44 of the crane, the independent power source 105 may then be actuated to operate the tracks of the crane in terms of all the full functions thereof, and as the power source for the electrical system of the crane. The operator now has the ability to control each of the tracks independently of one another through the use of the split control handle 113, 114. For example, by moving handle 114 forward, the left track 14 will move forward. Movement of handle 113 will move the right track in reverse thus effectively enabling the operator to turn the crane within its own radius. The movement of both handles 113 and 114 forwardly will move both the right and left tracks forward, while movement of the handles 113 and 114 rearwardly will move both tracks in reverse. Hence, independent control of each track is established from the cab portion of the crane.

It will be appreciated that the controls which control the various crane functions are similarly located in the cab portion of the crane 20, as is well known in the art. But as illustrated, the present invention provides an independent control system located in the cab of the crane 20 of controlling the independent movement of each of the tracks once installed on the frame.

In terms of the construction of the U-shaped tracks 130, it will be observed in FIG. 18 of the drawings that an electrical contract raceway 132 is provided adjacent the bottom of the Ushaped track 130 such that the contact shoe 127 will ride on the raceway 132 throughout the entire 360 degree arc of the crane 20.

The flexible hydraulic lines 107 (as illustrated in FIG. 17) in the preferred embodiment of the invention, are contemplated to be designed as quick disconnects, of the type generally known in the art, such that engagement and disengagement may be easily and quickly performed. It will be appreciated that as is known in the art, each of the tracks 14 includes a hydraulic motor 135 which in turn operate the track gears 109 in a manner which is again, known in the art. As indicated previously, hydraulic line connections via flexible hydraulic lines 107, are established as between the independent power source 105, and the hydraulic motors 1335, which in turn will operate the track gears 109, in a manner presently utilized on cranes of this construction.

It will therefore be appreciated from the aboe description, that pursuant to the present invention, an improved convertible truck crane has been provided. The improvements pursuant to the present invention permit a presently commercially available truck crane to be converted to a crawler crane by splitting the frame of the vehicle as well as the drive train thereof, utilizing mechanical and/or hydraulic/mechanical means for effecting the disengagement of the frame as well as the drive train. The drive train, as previously indicated, may be splined, and include a splined housing, such that the drive train may be easily engaged and/or disengaged when put into use. Hence, by effecting a splitting of the frame, the cab portion of the truck crane may be removed, after which the portable foldable tracks may be installed onto the rear frame section of the vehicle. By removing the cab portion, the resulting crawler crane which is now created eliminates the "no lift" quadranct presently encountered with truck cranes, that being the quadrant of lifting over the forward portion of the cab of the truck crane, and permits the crawler crane now created, to walk up to a load, lift the same, and walk with the load to any site location.

Furthermore, the present invention provides a truck crane convertible to a crawler crane configuration, wherein each of the portable tracks may be independently controlled from the crane cab, giving the oerator the ability to control the forward and reverse directions of the crane, as well as the speed of each of the tracks independently of one another.

While there has been described what is at present considered to be the preferred embodiments of the invention, it will be understood that various modifications may be made therein and is intended to cover in the appended claims all such modifications as fall within the true spirit and scope of the invention.

I claim:

1. A truck crane of the type having a crane mounted on a truck frame and using wheels for movement from one locale to another, being convertible to a self-powered crawler crane, comprisng in combination, a crane of the type having its own control system, mounted on a truck frame having a truck cab with its own power source and drive train and vehicle wheels mounted thereon to accommodate the movement of said crane from one locale to another, said crane further including an independent track control system mounted thereon, said truck frame being split and being engageably disengageable into a forward frame section and a rear frame section, said drive train being disengageable thereby to permit said forward frame section of said truck frame to be separable from said rear frame section thereof, said truck frame further including a plurality of outrigger beams positioned on opposed sides of said rear frame section, each of said outrigger beams provided with upstanding standards fixedly secured to the outer end thereof and said outrigger beam further provided with at least one aperture adjacent to and rearward of said upstanding standard, each of said upstanding standards accommodating an outrigger jack mounted therein and adapted to reciprocate between a raising position and a retracted position, said truck frame further including a plurality of first mount means positioned on opposed sides thereof, a pair of portable crane tracks, at least one of said pair of crane tracks having an independent power source carried thereon and further including flexible motive means for connecting said independent power source to said independent track control system, each of said pair of portable crane tracks including mounting fixtures positioned thereon for engageable mounting with said first means of said truck frame where said truck frame is elevated by said outrigger jacks when reciprocated into the raising position thereof, and adapted to raise the level fo said truck frame relative to the ground such that said vehicle wheels are above ground level when said crane tracks are mounted on said truck frame and said outrigger jacks reciprocated into the retracted position thereof, whereby said truck crane may be powered to a desired locale by the truck cab and thereafter, said truck cab forming said forward frame section being separated by disengaging said truck frame and drive train into said respective forward and rear frame sections, raising said truck frame by means of reciprocating outrigger jacks into the raising position thereof, employing said crane to maneuver said portable crane tracks into position relative to said truck frame until said frame first mount means and said crane tracks mounting fixtures are in registry and secured together and connecting said flexible motive means to said independent track control system such that said truck crane is converted into a crawler crane having its own independent power source.

2. The truck crane assembly as set forth in claim 1 above, wherein said first mount means comprises at least four upstanding standards formed integrally with said outrigger beams, one pair of said standards being positioned on each opposed side thereof and adapted for registry with said mounting fixtures of said portable crane tracks.

3. The truck crane assembly as set forth in claim 2 above, wherein said mounting fixture of said portable crane tracks is formed by a raised apertured gusset plate, said apertures in said raised gusset plate being positioned and sized to register with said apertures formed in said outrigger beams such that when said portable crane tracks are mounted on said truck frame, said truck frame and its included vehicle wheels are raised beyond ground level.

4. the truck crane assembly as set forth in claim 1 above, wherein each of said portable crane tracks is formed by a forward and rear support plates for supporting said tracks thereon, and having respective inner meeting ends, said forward and rear support plates being connected by a centrally positioned pivot plate whereby said forward and rear support plates are movable with respect to each other throughout an arc of approximately 180 degrees, whereby said portable crane tracks are foldable for ease of transportation.

5. The truck crane assembly as set forth in claim 4 above, wherein said power source on said crane track comprises a fuel powered engine fixedly secured to one of said support plates of said crane track, and said flexible motive means comprises a series of electrical lines and flexible hydraulic lines, said electrical and hydraulic lines extending from said crane control system and including connection fixtures for interconnecting said electrical and hydraulic lines to said power source of said tracks.

6. The truck crane assembly as set forth in claim 1 above, wherein said truck frame further includes separation means for effecting the separation of said frame into a forward frame section and a rear frame section.

7. The truck crane assembly as set forth in claim 6 above, wherein said separation means comprises at least one hydraulic cylinder including a cylinder rod, said hydraulic cylinder bing fixedly secured to one of said forward frame sectiona nd rear frame sections, and said cylinder rod being disengageably secured to the other of said sections whereby said hydraulic cylinder may be activated to retract said cylinder rod into said cylinder thereby to achieve separation of said forward and rear frame sections.

8. The truck crane assembly as set forth in claim 7 aobve, wherein said drive train is formed by a splined shaft end carried by one of said forward and rear frame sections, and an internally matingly splined housing carried by the other of said frame sections whereby said splined shaft end and splined housing may be alternately engaged and disengaged thereby to alternately unite and separate said drive train incident to the splitting and uniting of said forward and rear frame sections.

9. The truck crane assembly as set forth in claim 4 above, wherein said forward and rear support plates, and said pivot plate include securement means for securing said forward and rear support plates in horizontal alignment when in the unfolded use position.

10. The truck crane assembly as set forth in claim 9 above, wherein said securement means comprises at least one mounting aperture formed in said forward support plate and said rear support plate along the respective inner ends thereof, said pivot plate including corresponding mounting apertures formed therein such that said mounting apertures in said pivot plate and mounting apertures in said forward and rear support plates are in registry in the unfolded use position, and threaded bolts for insertion through and securement within said respective mounting apertures when in registry with one another.

* * * * *